US005307884A

United States Patent [19]

Millgard

[11] Patent Number: 5,307,884

[45] Date of Patent: May 3, 1994

[54] MULTI-LEVEL SAMPLING DEVICE

[75] Inventor: V. Dennis Millgard, Orchard Lake, Mich.

[73] Assignee: Millgard Environmental Corporation, Livonia, Mich.

[21] Appl. No.: 10,077

[22] Filed: Jan. 28, 1993

[51] Int. Cl.[5] ..... E21B 49/02

[52] U.S. Cl. ..... 175/20; 73/864.64; 175/58

[58] Field of Search ..... 175/20, 58, 59; 73/864.64, 864.63

[56] References Cited

U.S. PATENT DOCUMENTS

| | | | |
|---|---|---|---|
| 3,036,638 | 5/1962 | Parsons | 175/20 X |
| 4,359,110 | 11/1982 | Peterson | 175/20 |
| 4,383,583 | 5/1983 | Baker | 175/20 |
| 5,135,058 | 8/1992 | Millgard et al. | 175/21 X |
| 5,209,129 | 5/1993 | Jaselskis et al. | 175/20 X |

FOREIGN PATENT DOCUMENTS

| | | | |
|---|---|---|---|
| 931200 | 8/1955 | Fed. Rep. of Germany | 73/864.64 |
| 484331 | 11/1954 | Italy | 73/864.64 |
| 144960 | 4/1954 | Sweden | 73/864.64 |

*Primary Examiner*—Hoang C. Dang
*Attorney, Agent, or Firm*—Dinnin & Dunn

[57] ABSTRACT

Multi-level sampling device including compartmentalized longitudinal member for lowering into loose-material to be tested at multiple levels providing for individual containers to be simultaneously filled at each respective level through a retraction of covering lids to accommodate pouring of the material into the containers followed by closing the lids and retracting the sampling device for inspection of the material in each respective container.

11 Claims, 2 Drawing Sheets

MULTI-LEVEL SAMPLING DEVICE

BACKGROUND OF THE INVENTION

U.S. Pat. No. 5,135,058, entitled Crane-Mounted Drill and Method for In-Situ Treatment of Contaminated Soil, discloses an elongated hollow drive shaft mounted for rotation about its axis while being supported in vertical orientation. The upper end of the drive shaft is connected for selected injection of fluid under pressure into the shaft and a drill is affixed to the lower end of the shaft for drilling a hole downwardly through the soil. The drill comprises a hollow sleeve mounted to the lower end of the shaft and extending therefrom coaxially with the shaft. A pair of drill blades are cantilevered from the sleeve, and extend outwardly therefrom at right angles diametrically opposite to and aligned with each other.

Each blade is of identical uniform cross section and carries a plurality of radially spaced drill teeth oriented tangentially of the sleeve along a leading radial edge of the blade. A hollow pipe extends along the trailing edge of each blade and has orifices for injecting fluid from the sleeve and pipe into the earth as the blade is rotated. A plate is affixed to each blade to deflect soil away from the nozzle orifices as the drill is rotated.

In operation, when drill teeth are brought into engagement with the earth surface, continued driving of the drill combines with angle of attack of the teeth to propel the drill downwardly into the earth's surface at a rate controlled to obtain proper mixing and penetration of the soil. During rotation, a deflector functions to shield nozzle orifices from dirt flowing over the upper surface of the blades. During drilling into and/or removal from the earth, fluid under pressure is fed to the Kelly bar by a fluid control system. Fluid treatment media may comprise hot air or steam to drive off volatile organic compounds that are collected by a shroud; microbes, hydrogen peroxide or a phosphorous/nitrogen solution for bioreclamation for creosote-contaminated and hydrocarbon contaminated soil; cement, flyash or silicaceous material to solidify and entomb heavy metals; or a neutralizing agent to stabilize pond sludge.

In order to sample and test at progressive depths the condition of the loose soil after treatment, it has heretofore been normal practice to obtain samples one by one by lowering to progressive depths a tool having means to retrieve a sample which may be raised to the surface for inspection.

BRIEF DESCRIPTION OF THE PRESENT INVENTION

The present multi-level sampling device has been developed to provide an accurate simultaneous sampling of material mix at progressive levels. An I-beam of appropriate length, e.g., seventeen feet, is lowered vertically within the loose material mix to a sampling level. Sample container cylinders at sampling intervals along the I-beam are uncovered and permitted to fill with samples of the material at each respective level. As the I-beam is withdrawn, the sample containers are progressively removed for inspection.

DETAILED DESCRIPTION OF PREFERRED EMBODIMENT

Figure 1:
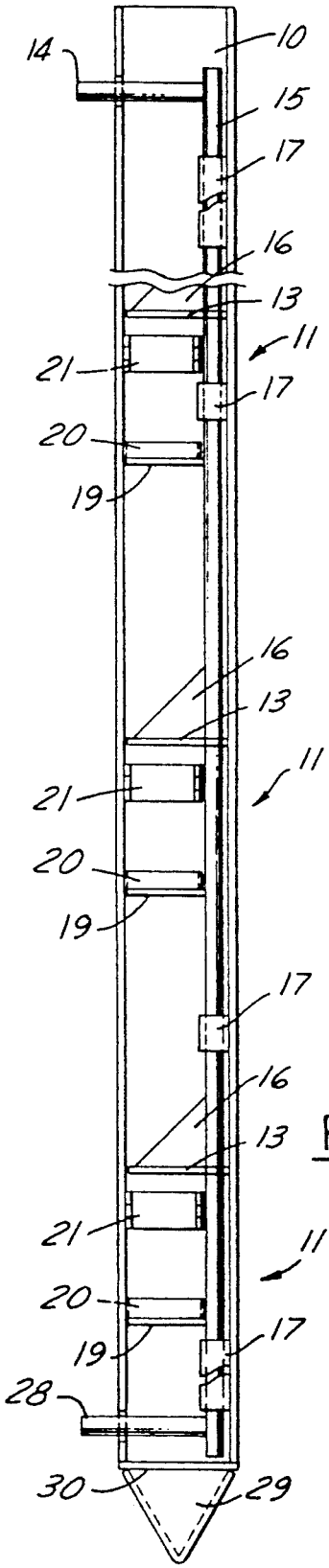
FIG. 1 is an elevation illustrating the device for sampling at each level.
Figure 2:
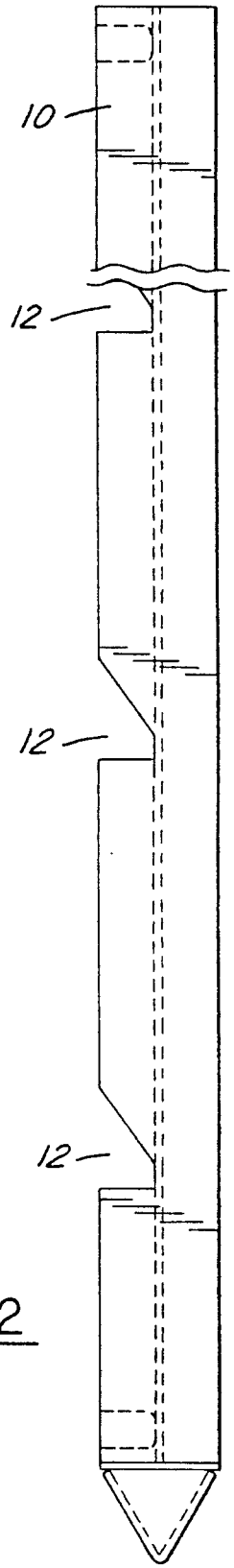
FIG. 2 is a side elevation of the sampling device illustrated in FIG. 1.

With reference to FIGS. 1 and 2, I-beam 10, typically seventeen feet long, is provided with multiple sampling stations 11, typically five, three of which are illustrated in the broken view of FIG. 1. The hidden view of stations 11 is omitted in the side elevation of FIG. 2, which does illustrate however, cutouts 12 at each station providing access for entry flow of material to be sampled when covers 13 are swung by handle 14 and rod 15 from the closed position illustrated in FIG. 1 to an open position. Gussets 16, as well as covers 13, are welded to rod 15, which is rotatably mounted in bushing 17 and which is in turn welded to one flange of I-beam 10.

Figure 3:
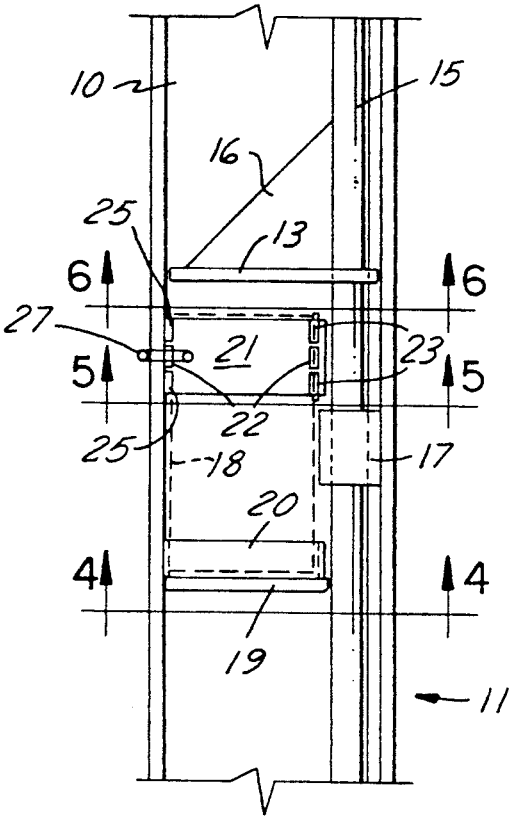
FIG. 3 is an enlarged fragmentary view of one of the sampling stations illustrated in the sampling device of FIG. 1.
Figure 4:
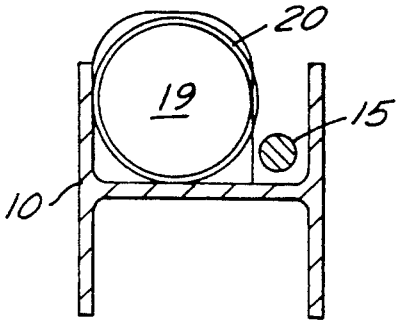
FIGS. 4, 5 and 6 are respective sectional views taken along the lines 4—4, 5—5 and 6—6 of FIG. 3.
Figure 5:
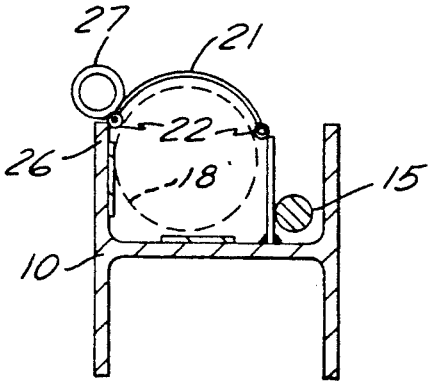
Figure 6:
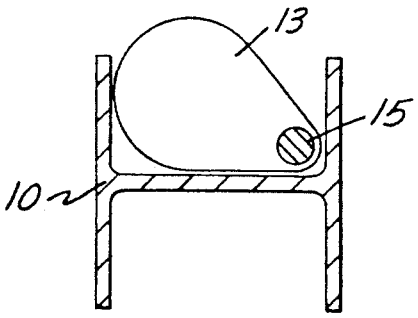

Separate cylindrical sampling containers 18, one of which is illustrated in FIGS. 3 and 5, are inserted through cutouts 12 while lids 13 are retracted by handle 14 to an open position. The containers are seated on plates 19 and retained by rings 20 and straps 21 after closure of lids 13, while the sampling device is lowered to the required sampling level. Such lowering may be effected by Kelly bar or other suitable means not shown, whereupon handle 14 is actuated to rotate lids 13 to an open position, where a sample of the loose material can flow through cutouts 12 into the respective containers.

After dwell time sufficient to fill the containers, the sampling device is progressively withdrawn to a level where each container with sample may be removed for inspection.

With reference to FIGS. 3-6, illustrated in enlarged detail in one of the sampling stations, strap 21 is provided with knuckle 22 welded to each end of the strap for pin engagement with matching knuckle 23, welded to plate 24 and knuckle 25 welded to flange 26 of I-beam 10. Ring 27, welded to strap 21 and knuckle 22, is adapted for retention and removal of the cylindrical material containers.

In summary, operation of the multi-level sampling device of the present invention involves opening of lids 13 above ground level with lower handle 28; inserting sample containers 18 in each of the sampling stations 11; using strap 21 pinned at knuckle 25 to retain the container closing lid 13 over the container, again utilizing lower handle 28; lowering the sampling device, facilitated by four triangular plates 29 welded to each other and plate 30 to provide an entering point; opening all lids 13 simultaneously with handle 14 when the sampling level has been reached; dwelling while each of the sampling containers is filled through cutouts 12; closing lids 13 with handle 14; retraction of the sampling device; opening the lids; and removing the respective containers for inspection.

I claim:

1. Multi-level sampling device comprising elongate rigid member having multiple progressively spaced sampling compartments, each with means for holding an individual removable sample container, a removable sample container in each of said compartments, means for covering said containers during lowering of said member to a sampling level, and means for uncovering said containers to provide simultaneous access for material flow into each sample container at each respective level.

2. Sampling device of claim 1 wherein said means for covering comprises a lid for each container mounted on a common elongate pivot shaft.

3. Sampling device of claim 2 including a handle projecting from the top of said shaft for rotating said shaft and lids into open and closed position.

4. Sampling device of claim 3 including a second handle projecting from the bottom of said shaft.

5. Sampling device of claim 1 including a fixed retainer for the bottom of each individual material container.

6. Sampling device of claim 5 including hinged strap means for retaining an intermediate body of each container.

7. Sampling device of claim 6 including hinge pin means for retaining said strap means in closed position.

8. Sampling device of claim 3 wherein said handle comprises means for closing said lids after material sample filling of said containers and prior to retraction of said elongate member.

9. Sampling device of claim 2 wherein said elongate member comprises an I-beam.

10. Sampling device of claim 9 including flange cutouts for material access above the lid level of each container.

11. Sampling device of claim 10 wherein each lid is provided with a gusset secured to said shaft and each cutout provides gusset clearance upon opening of the lids.

* * * * *